US005827055A

United States Patent [19]

Rice

[11] Patent Number: 5,827,055

[45] Date of Patent: Oct. 27, 1998

[54] BUTANE LOCK DE-ICER

[76] Inventor: Norman Rice, 6118 Ridge Rd., Florence, Ky. 41042

[21] Appl. No.: 897,892

[22] Filed: Jul. 21, 1997

[51] Int. Cl.[6] ..... F23Q 7/12

[52] U.S. Cl. ..... 431/255; 126/229

[58] Field of Search ..... 431/255; 126/229, 126/226, 271.2 R

[56] References Cited

U.S. PATENT DOCUMENTS 3,023,748 3/1962 Bruskin ..... 126/229

4,304,024 12/1981 Branscheid et al. ..... 15/105

*Primary Examiner*—Carroll B. Dority

[57] ABSTRACT

A new BUTANE LOCK DE-ICER for warming frozen door locks of vehicles for unlocking The inventive device includes a cylindrical container having an opening therethrough with a circular recess disposed around the opening. The container holds an amount of butane therein. A flame system is secured within the opening in the top end of the housing. An ignition system is secured within the cylindrical container in communication with the flame system. A lock receiving receptacle is coupled with respect to the top end of the cylindrical container. The lock receiving receptacle extends through the circular recess through the top end of the container. A safety switch extends inwardly of the cylindrical container disposed below the lock receiving receptacle.

6 Claims, 3 Drawing Sheets

BUTANE LOCK DE-ICER

BACKGROUND OF THE INVENTION

1. Field of the Invention

The present invention relates to lock openers and more particularly pertains to a new BUTANE LOCK DE-ICER for warming frozen door locks of vehicles for unlocking.

2. Description of the Prior Art

The use of lock openers is known in the prior art. More specifically, lock openers heretofore devised and utilized are known to consist basically of familiar, expected and obvious structural configurations, notwithstanding the myriad of designs encompassed by the crowded prior art which have been developed for the fulfillment of countless objectives and requirements.

Known prior art lock openers include U.S. Pat. No. 4,304,548 to Ruhaut et al.; U.S. Pat. No. 4,304,024 to Branscheid et al.; U.S. Pat. No. Des. 273,049 to Lam et al.; U.S. Pat. No. 4,058,995 to Greaves; U.S. Pat. No. 4,123,648 to Clark and U.S. Pat. No. 5,442,529 to Hoover.

While these devices fulfill their respective, particular objectives and requirements, the aforementioned patents do not disclose a new BUTANE LOCK DE-ICER. The inventive device includes a cylindrical container having an opening therethrough with a circular recess disposed around the opening. The container holds an amount of butane therein. A flame system is secured within the opening in the top end of the housing. An ignition system is secured within the cylindrical container in communication with the flame system. A lock receiving receptacle is coupled with respect to the top end of the cylindrical container. The lock receiving receptacle extends through the circular recess through the top end of the container. A safety switch extends inwardly of the cylindrical container disposed below the lock receiving receptacle.

In these respects, the BUTANE LOCK DE-ICER according to the present invention substantially departs from the conventional concepts and designs of the prior art, and in so doing provides an apparatus primarily developed for the purpose of warming frozen door locks of vehicles for unlocking.

SUMMARY OF THE INVENTION

In view of the foregoing disadvantages inherent in the known types of lock openers now present in the prior art, the present invention provides a new BUTANE LOCK DE-ICER construction wherein the same can be utilized for warming frozen door locks of vehicles for unlocking.

The general purpose of the present invention, which will be described subsequently in greater detail, is to provide a new BUTANE LOCK DE-ICER apparatus and method which has many of the advantages of the lock openers mentioned heretofore and many novel features that result in a new BUTANE LOCK DE-ICER which is not anticipated, rendered obvious, suggested, or even implied by any of the prior art lock openers, either alone or in any combination thereof.

To attain this, the present invention generally comprises a cylindrical container having a top end, a bottom end and a cylindrical side wall therebetween. The top end has an opening therethrough with a circular recess disposed around the opening. The cylindrical container has a hollow interior defined by a lower chamber, an intermediate chamber and an upper chamber. The lower chamber and the intermediate chamber are separated by a lower support plate. The intermediate chamber and the upper chamber are separated by an intermediate support plate. The intermediate support plate has an aperture therethrough. The lower chamber holds an amount of butane therein. A sliding support plate is slidably disposed within the upper chamber of the cylindrical container. The sliding support plate has an aperture therethrough in alignment with the opening in the top end of the container. The sliding support plate has a pair of springs extending downwardly therefrom to couple with the intermediate support plate. A flame system including a flame housing is secured within the opening in the top end of the housing. The flame system includes a flame nozzle disposed within the flame housing. The flame housing has a pair of coils extending upwardly therefrom. A propane hose extends from the flame nozzle downwardly in the lower chamber for being in fluid communication with the butane therein. An ignition system including an ignition switch is secured to the lower support plate of the cylindrical container. The ignition switch has an activation switch disposed on an upper end thereof disposed below the aperture through the intermediate support plate. The ignition system includes a switch arm extending downwardly from the sliding support plate disposed above the aperture through the intermediate support plate. The ignition system includes a wire extending between the ignition switch and the fuel nozzle. A lock receiving receptacle is coupled with respect to the top end of the cylindrical container. The lock receiving receptacle includes a cylindrical shield having an open lower end extending through the circular recess through the top end of the container and is secured to the sliding support plate. The cylindrical shield has an opening through an upper end thereof that is adapted for coupling with a keyhole of an automobile. The cylindrical shield has a plurality of air vents therethrough. A safety switch extends inwardly of the cylindrical container disposed below the sliding support plate. The safety switch includes an interior portion that extends below the sliding support plate in a disengaged orientation and retracts inwardly within the safety switch in an engaged orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new BUTANE LOCK DE-ICER apparatus and method which has many of the advantages of the lock openers mentioned heretofore and many novel features that result in a new BUTANE LOCK DE-ICER which is not anticipated, rendered obvious, suggested, or even implied by any of the prior art lock openers, either alone or in any combination thereof.

It is another object of the present invention to provide a new BUTANE LOCK DE-ICER which may be easily and efficiently manufactured and marketed.

It is a further object of the present invention to provide a new BUTANE LOCK DE-ICER which is of a durable and reliable construction.

An even further object of the present invention is to provide a new BUTANE LOCK DE-ICER which is susceptible of a low cost of manufacture with regard to both materials and labor, and which accordingly is then susceptible of low prices of sale to the consuming public, thereby making such BUTANE LOCK DE-ICER economically available to the buying public.

Still yet another object of the present invention is to provide a new BUTANE LOCK DE-ICER which provides in the apparatuses and methods of the prior art some of the advantages thereof, while simultaneously overcoming some of the disadvantages normally associated therewith.

Still another object of the present invention is to provide a new BUTANE LOCK DE-ICER for warming frozen door locks of vehicles for unlocking.

Yet another object of the present invention is to provide a new BUTANE LOCK DE-ICER which includes a cylindrical container having an opening therethrough with a circular recess disposed around the opening. The container holds an amount of butane therein. A flame system is secured within the opening in the top end of the housing. An ignition system is secured within the cylindrical container in communication with the flame system. A lock receiving receptacle is coupled with respect to the top end of the cylindrical container. The lock receiving receptacle extends through the circular recess through the top end of the container. A safety switch extends inwardly of the cylindrical container disposed below the lock receiving receptacle.

Still yet another object of the present invention is to provide a new BUTANE LOCK DE-ICER that melts ice and snow around the keyhole and thaw any moisture within the lock cylinder.

Even still another object of the present invention is to provide a new BUTANE LOCK DE-ICER that has a push button safety that must be depressed in order to activate the flame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
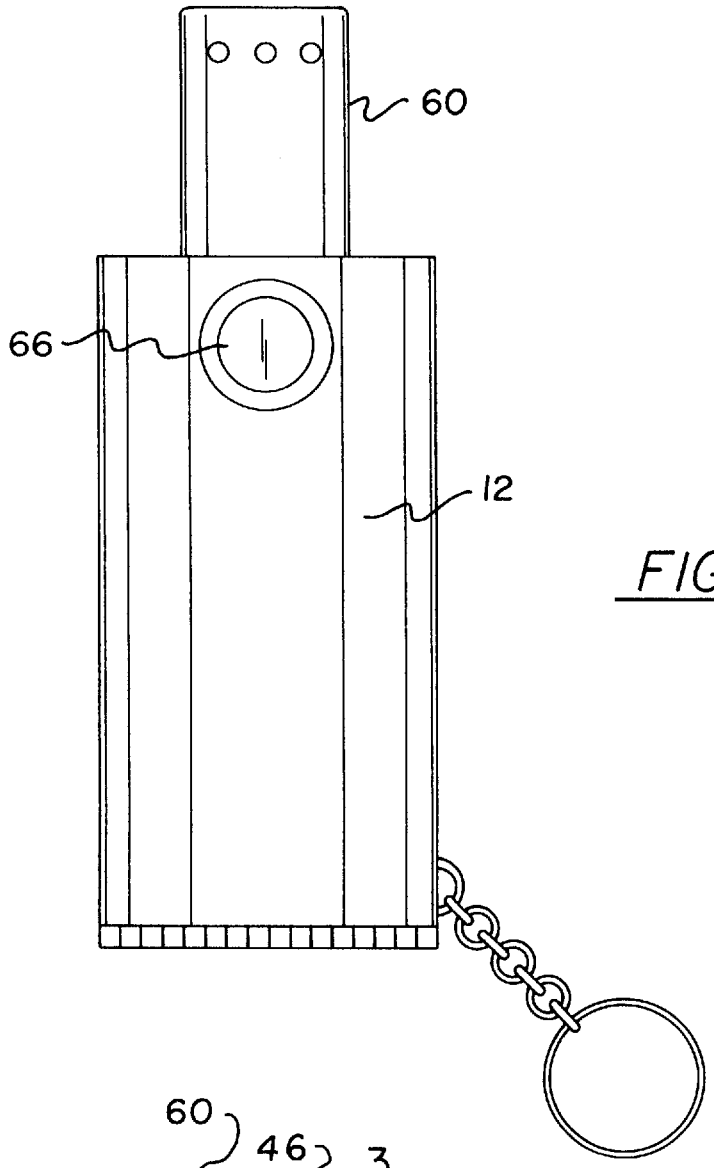
FIG. 1 is an upper perspective view of a new BUTANE LOCK DE-ICER according to the present invention.
Figure 2:
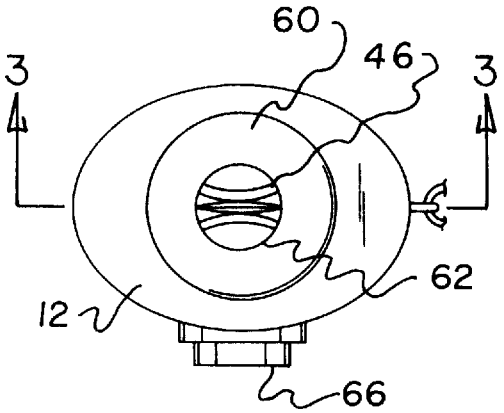
FIG. 2 is a top plan view of the present invention.
Figure 3:
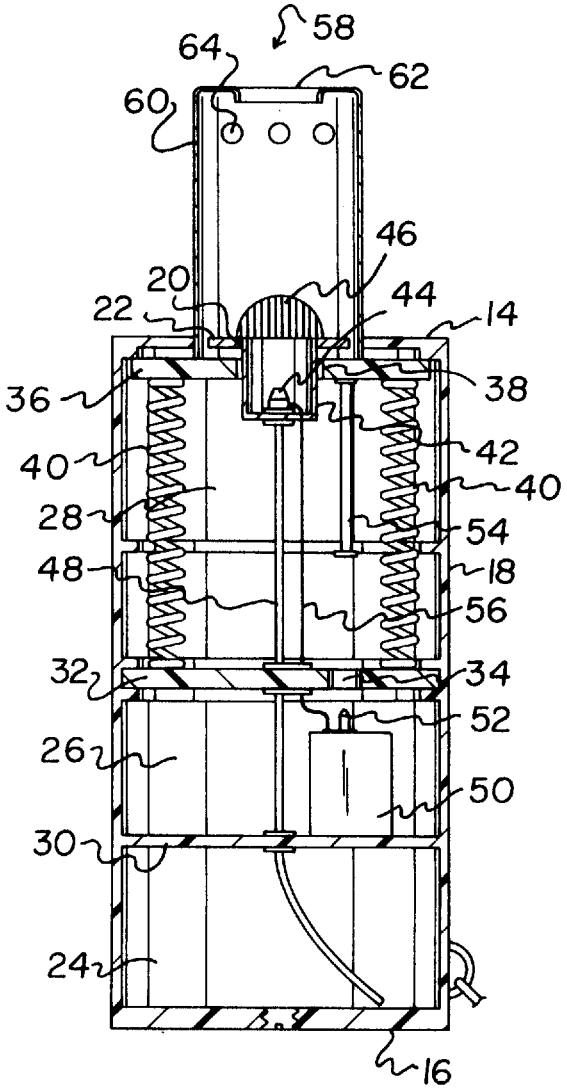
FIG. 3 is a cross-sectional view of the present invention as taken along line 3—3 of FIG. 2.
Figure 4:
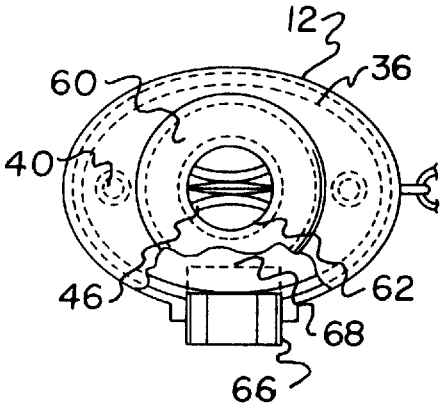
FIG. 4 is a top plan view of the present invention shown in cross-section illustrated in a disengaged orientation.
Figure 5:
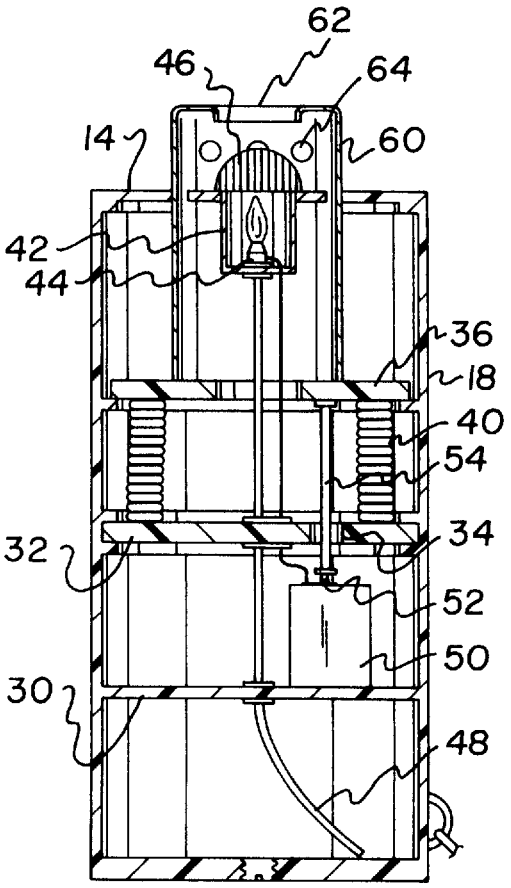
FIG. 5 is a cross-sectional view of the present invention illustrated in an engaged orientation.
Figure 6:
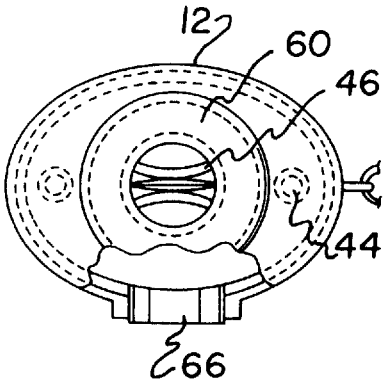
FIG. 6 is a cross-sectional top view of the present invention illustrated in the engaged orientation.

With reference now to the drawings, and in particular to FIGS. 1 through 6 thereof, a new BUTANE LOCK DE-ICER embodying the principles and concepts of the present invention and generally designated by the reference numeral 10 will be described.

More specifically, it will be noted that the BUTANE LOCK DE-ICER comprises a cylindrical container 12 having a top end 14, a bottom end 16 and a cylindrical side wall 18 therebetween. The top end 14 has an opening 20 therethrough with a circular recess 22 disposed around the opening 20. The cylindrical container 12 has a hollow interior defined by a lower chamber 24, an intermediate chamber 26 and an upper chamber 28. The lower chamber 24 and the intermediate chamber 26 are separated by a lower support plate 30. The intermediate chamber 26 and the upper chamber 28 are separated by an intermediate support plate 32. The intermediate support plate 32 has an aperture 34 therethrough. The lower chamber 24 holds an amount of butane therein.

A sliding support plate 36 is slidably disposed within the upper chamber 28 of the cylindrical container 12. The sliding support plate 36 has an aperture 38 therethrough in alignment with the opening 20 in the top end 14 of the container 12. The sliding support plate 36 has a pair of springs 40 extending downwardly therefrom to couple with the intermediate support plate 32. The springs 40 serve to bias the sliding support plate 36 upwardly to abut the top end 14 of the container 12.

A flame system including a flame housing 42 is secured within the opening 20 in the top end 14 of the container 12. The flame system includes a flame nozzle 44 disposed within the flame housing 42. The flame housing 42 has a pair of coils 46 extending upwardly therefrom. A propane hose 48 extends from the flame nozzle 44 downwardly in the lower chamber 24 for being in fluid communication with the butane therein.

An ignition system including an ignition switch 50 is secured to the lower support plate 30 of the cylindrical container 12. The ignition switch 50 has an activation switch 52 disposed on an upper end thereof disposed below the aperture 34 through the intermediate support plate 32. The ignition system includes a switch arm 54 extending downwardly from the sliding support plate 36 disposed above the aperture 34 through the intermediate support plate 32. The ignition system includes a wire 56 extending between the ignition switch 50 and the flame nozzle 44.

A lock receiving receptacle 58 is coupled with respect to the top end 14 of the cylindrical container 12. The lock receiving receptacle 58 includes a cylindrical shield 60 having an open lower end extending through the circular recess 22 through the top end 14 of the container 12 and is secured to the sliding support plate 36. The cylindrical shield 60 has an opening 62 through an upper end thereof that is adapted for coupling with a keyhole of an automobile. The cylindrical shield 60 has a plurality of air vents 64 therethrough.

A safety switch 66 extends inwardly of the cylindrical container 12 disposed below the sliding support plate 36. The safety switch 66 includes an interior portion 68 that extends below the sliding support plate 36 in a disengaged orientation and retracts inwardly within the safety switch 66 in an engaged orientation.

In use, the opening 62 in the cylindrical shield 60 of the lock receiving receptacle 58 is placed over a key lock of an automobile. The safety switch 66 is pressed inwardly to retract the interior portion 68 within the safety switch 66 thereby allowing the sliding support plate 36 to slide freely within the upper chamber 28. By pushing inwardly against the key lock, the cylindrical shield 60 will move inwardly of the cylindrical container 12 thereby causing the sliding support plate 36 to move inwardly thereby causing the switch arm 54 to move inwardly to contact the activation switch 52 of the ignition switch 50 thereby allowing the flame nozzle 44 to generate a flame (Note Figure). The flame will help melt and thaw the key lock of the automobile.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A butane lock de-icer comprising:

a cylindrical container having a top end, a bottom end and a cylindrical side wall therebetween, the top end having an opening therethrough with a circular recess disposed around the opening, the cylindrical container having a hollow interior defined by a lower chamber, an intermediate chamber and an upper chamber, the lower chamber and the intermediate chamber being separated by a lower support plate, the intermediate chamber and the upper chamber being separated by an intermediate support plate, the intermediate support plate having an aperture therethrough, the lower chamber holding an amount of butane therein;

a sliding support plate slidably disposed within the upper chamber of the cylindrical container, the sliding support plate having an aperture therethrough in alignment with the opening in the top end of the container, the sliding support plate having a pair of springs extending downwardly therefrom to couple with the intermediate support plate;

a flame system including a flame housing secured within the opening in the top end of the housing, the flame system includes a flame nozzle disposed within the flame housing, the flame housing having a pair of coils extending upwardly therefrom, a propane hose extending from the flame nozzle downwardly in the lower chamber for being in fluid communication with the butane therein;

an ignition system including an ignition switch secured to the lower support plate of the cylindrical container, the ignition switch having an activation switch disposed on an upper end thereof disposed below the aperture through the intermediate support plate, the ignition system including a switch arm extending downwardly from the sliding support plate disposed above the aperture through the intermediate support plate, the ignition system including a wire extending between the ignition switch and the fuel nozzle;

a lock receiving receptacle coupled with respect to the top end of the cylindrical container, the lock receiving receptacle including a cylindrical shield having an open lower end extending through the circular recess through the top end of the container and secured to the sliding support plate, the cylindrical shield having an opening through an upper end thereof adapted for coupling with a keyhole of an automobile, the cylindrical shield having a plurality of air vents therethrough; and a safety switch extending inwardly of the cylindrical container disposed below the sliding support plate, the safety switch including an interior portion extending below the sliding support plate in a disengaged orientation and retracting inwardly within the safety switch in an engaged orientation.

2. A butane lock de-icer comprising:

a cylindrical container having an opening therethrough with a circular recess disposed around the opening, the container holding an amount of butane therein;

a flame system secured within the opening in the top end of the housing;

an ignition system secured within the cylindrical container in communication with the flame system;

a lock receiving receptacle coupled with respect to the top end of the cylindrical container, the lock receiving receptacle extending through the circular recess through the top end of the container; and a safety switch extending inwardly of the cylindrical container disposed below the lock receiving receptacle.

3. The butane lock de-icer as set forth in claim 2 and further including a sliding support plate slidably disposed within the cylindrical container, the sliding support plate having an aperture therethrough in alignment with the opening in the top end of the container, the sliding support plate secured to a lower end of the lock receiving receptacle, the sliding support plate having a pair of springs extending downwardly therefrom to couple with an intermediate support plate disposed therebelow.

4. The butane lock de-icer as set forth in claim 2 wherein the flame system includes a flame housing secured within the opening in the top end of the housing, the flame system includes a flame nozzle disposed within the flame housing, the flame housing having a pair of coils extending upwardly therefrom, a propane hose extending from the flame nozzle downwardly in the container for being in fluid communication with the butane therein.

5. The butane lock de-icer as set forth in claim 3 wherein the ignition system includes an ignition switch secured within the cylindrical container disposed above the butane therein, the ignition switch having an activation switch disposed on an upper end thereof, the ignition system including a switch arm extending downwardly from the sliding support plate, the ignition system including a wire extending between the ignition switch and the flame system.

6. The butane lock de-icer as set forth in claim 3 wherein the lock receiving receptacle includes a cylindrical shield having an open lower end extending through the circular recess through the top end of the container and secured to the sliding support plate, the cylindrical shield having an opening through an upper end thereof adapted for coupling with a keyhole of an automobile, the cylindrical shield having a plurality of air vents therethrough.

* * * * *